United States Patent [19]

Wolstencroft

[11] 4,137,614

[45] Feb. 6, 1979

[54] PREPARATION OF A WARP BEAM WOUND WITH FLEXIBLE TAPES

[75] Inventor: Michael J. Wolstencroft, Kingston, Canada

[73] Assignee: Du Pont of Canada Limited, Montreal, Canada

[21] Appl. No.: 776,232

[22] Filed: Mar. 10, 1977

[30] Foreign Application Priority Data

Mar. 11, 1976 [CA] Canada ..... 247717

[51] Int. Cl.[2] ..... D02H 11/00

[52] U.S. Cl. ..... 28/172; 28/170; 28/190; 28/194; 242/56.2

[58] Field of Search ..... 28/166, 170, 172, 190, 28/194; 66/125 A; 83/18, 175; 242/56.2

[56] References Cited

U.S. PATENT DOCUMENTS

| | | | |
|---|---|---|---|
| 1,164,650 | 12/1915 | Ireland et al. | 83/175 |
| 1,901,250 | 3/1933 | Mattler | 139/11 |
| 2,169,886 | 8/1939 | Shaw | 28/194 |
| 2,593,154 | 4/1952 | Judelson | 242/56.3 |
| 2,596,246 | 5/1952 | Johnson et al. | 333/24.2 |
| 3,072,998 | 1/1963 | Bigl | 28/194 |
| 3,214,943 | 11/1965 | Marks | 66/125 |
| 3,336,645 | 8/1967 | Mirsky | 28/166 |
| 3,820,427 | 6/1974 | Stomph | 83/18 |

FOREIGN PATENT DOCUMENTS

| | | |
|---|---|---|
| 1035227 | 7/1966 | United Kingdom. |
| 1067514 | 5/1967 | United Kingdom. |

*Primary Examiner*—Robert Mackey

[57] ABSTRACT

An improved process is disclosed for preparing a warp beam wound with tapes slit from at least two webs of superimposed flexible film at least 1 m wide, comprising feeding the slit superimposed tapes through nip rolls, separating the tapes at the nip and winding the tapes onto a warp beam.

10 Claims, 4 Drawing Figures

PREPARATION OF A WARP BEAM WOUND WITH FLEXIBLE TAPES

This invention relates to the preapration of flexible tapes from at least two superimposed, substantially continuous flexible webs.

Manufacture of woven fabrics from tapes slit from flexible webs is known. One method involves continuous extrusion of thermoplastic polymer into film form, quenching the film, slitting it longitudinally into a plurality of thermoplastic tapes, drawing and orienting each flexible thermoplastic tape and thereafter winding the oriented tapes onto bobbins. In a subsequent operation, known as beam warping, up to about two thousand five hundred tapes are wound from the aforementioned bobbins, which are mounted in a creel, onto a so-called warp beam. The warp beam, when fully wound with tapes, is transferred to a weaving machine, the tapes on the warp beam being used to form the warp of a woven fabric. The main disadvantages of this method of manufacturing woven fabrics are high capital investment for a large number of bobbin wind-up stations and a creel with a large number of bobbin unwind stations, and high manual involvement in the process, e.g., the doffing of fully wound bobbins, and continually ensuring that all the bobbins in the creel have tape for feeding to the warp beam.

In another method, flat film from a roll is slit into a plurality of longitudinally extending tapes and the tapes so formed may be wound onto a warp beam in readiness for weaving in a subsequent operation or may be fed directly to a weaving machine. This method, to a large extent, overcomes the disadvantages of the method previously described, but is limited to preparing a warp beam or woven fabric of substantially the same width as the roll of flat film available or the width of the slitting devices available, whichever is the narrower. It is known to overcome this limitation by arranging rolls of film side by side, separately slitting each roll of film into tapes and winding the tapes so obtained directly onto a warp beam.

It is also known to prepare a warp beam wound with tapes from narrow webs of film by superimposing webs of film, slitting the superimposed webs into tapes, separating the tapes so obtained and winding the tapes onto a narrow beam. In a process for slitting narrow superimposed webs of film or wide single webs of film into a plurality of tapes, it is known to use a plurality of knife blades, cutters, scissors, shearing discs having both edges used in shear, heated wires, sparks, or like means for slitting said webs of film. Knife blades and cutters have the disadvantage that the edges tend to dull quickly; shearing discs having both edges used in shear require close tolerances and tend to be difficult to maintain; and electrical devices tend to be difficult to use and maintain. For slitting narrow superimposed webs of film it is preferred to use a plurality of pairs of spaced rotary scissor blades mounted on two shafts, because they are self-sharpening and the spacing between pairs of blades may be relatively easily changed. Complementary pairs of scissor blades are allowed to contact at their periphery, normally with an overlap of approximately 1 to 100 times the thickness of the films to be slit. Attempts to slit wide superimposed webs of film have not been successful without strengthening the shafts or supporting them along their length because the considerable forces exerted by the superimposed films and the considerable forces applied along the shafts, to ensure contact of all pairs of scissor blades, may cause the scissor blades to break. Strengthening wide shafts make the apparatus unacceptably heavy and cumbersome and supports such as bearings make periodic adjustment difficult. Conventional supports such as bearings are also relatively wide, resulting in a large gap between pairs of scissors on either side of the bearing, which causes a wide tape to be cut from the web. This wide tape must be removed to waste.

It has now been found that in order to provide adequate support to the two shafts bearing the plurality of pairs of scissor blades, apart from supporting the shafts at each end, it is only necessary to support each shaft on the side opposite to the side where the scissor blades enmesh. Provision of such support substantially prevents said shafts from bowing away from one another, thus substantially preventing complementary scissor blades from becoming misaligned, bent or broken.

The angle between one of the outermost tapes of the separated tapes and a line perpendicular to the warp beam rotational axis lying in the plane bounded on two edges by the slitting devices and the warp beam and referred to hereinafter, is defined as the outer separation angle. In conventional processes referred to heretofore, for winding tapes onto a warp beam, the tapes are fed onto the warp beam at an angle substantially perpendicular to the axis of rotation of the warp beam, the outer separation angle rarely being greater than about 2°.

Surprisingly, it has now been found that by placing a pair of undriven nip rolls directly after the slitting devices, the outer separation angle may be increased to as high as 15°, thus reducing the distance needed between the warp beam and the slitting devices by as much as 85%.

It is an object of the present invention to provide a process by which warp beams of at least about one meter in width having flexible tapes wound thereon may be prepared for subsequent use in a weaving process from at least two superimposed webs of flexible film.

Accordingly, the present invention provides a process for preparing a warp beam wound with a plurality of tapes slit from at least two substantially continuous flat webs of flexible film superimposed upon each other, each web being at least 1 meter wide, said process comprising the steps of (a) removing wrinkles from said webs of flexible film;
(b) superimposing said webs;
(c) slitting the superimposed webs longitudinally into a plurality of tapes; and thereafter feeding the superimposed tapes so formed through a pair of nip rolls;
(d) separating the superimposed tapes at the nip of said nip rolls; each separated tape slit from one of the superimposed webs being arranged in the same plane with and in proximity to companion tapes slit from the other webs;
(e) winding the separated tapes onto at least one driven warp beam;
(f) applying tension to each web sufficient to give all of the tapes substantially the same tension at the warp beam.

In a preferred embodiment, the substantially continuous flat webs are supplied from rolls of film arranged in tandem. In another embodiment, the rolls are comprised of webs of oriented thermoplastic polymeric film, and more particularly of oriented polyethylene or polypropylene film.

The invention may be illustrated by reference to the accompanying drawings wherein.

Figure 1:
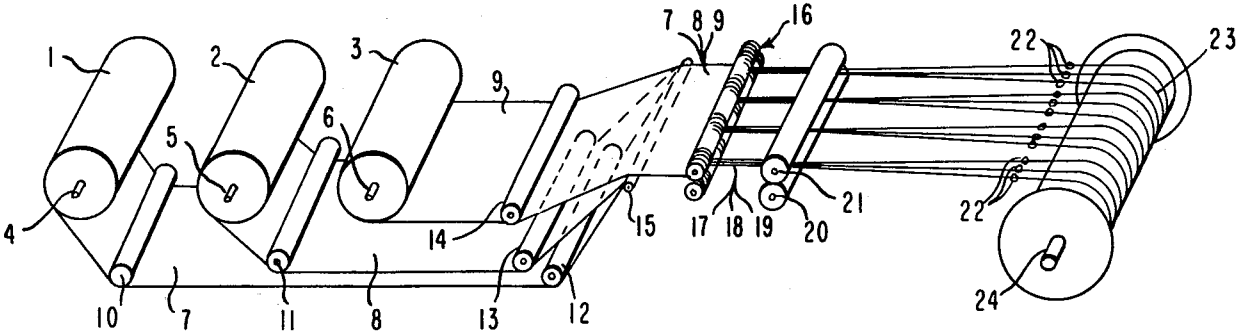
FIG. 1 is a schematic view of apparatus arranged to carry out the process of the present invention.

In the drawings, FIG. 1 shows rolls of film 1, 2 and 3 mounted on shafts 4, 5 and 6, respectively. Shafts 4, 5 and 6 are journalled in bearings (not shown) and have braking devices (not shown) for controlling tensions of webs of film 7, 8 and 9, pulled from rolls 1, 2 and 3 of film, respectively. Freely rotatable guide rollers 10 and 11 provide a means for allowing the webs free paths of travel between the rolls of film and the freely rotatable bowed rollers 12, 13 and 14. Bowed rollers 12, 13 and 14 provide means for removing wrinkles from webs of film 7, 8 and 9, respectively. A freely rotatable alignment roller 15 serves both as a means for superimposing webs of film 7, 8 and 9 and for aligning the superimposed webs, in preparation for feeding through a slitting device 16. The slitting device 16 shown in the drawings, particularly FIGS. 2 and 3, comprises a plurality of complementary pairs of circular scissor blades 27 and 28 mounted upon two driven rotatable shafts 25 and 26, respectively. Adjacent scissor blades mounted on shaft 25 are separated by spacers 29, and blades on shaft 26 are separated by similar spacers 30. Freely rotatable nip rolls 20 and 21 provide means for correctly aligning superimposed webs 7, 8 and 9 and tapes slit from the webs as they pass through the slitting device 16. Guides 22 provide means for separating the tapes slit from the film webs, and for positioning the tapes in preparation for winding onto a warp beam, 23. Warp beam 23 is mounted on a shaft or axle 24 which is journalled in bearings (not shown) and driven by a motor (not shown).

Figure 3:
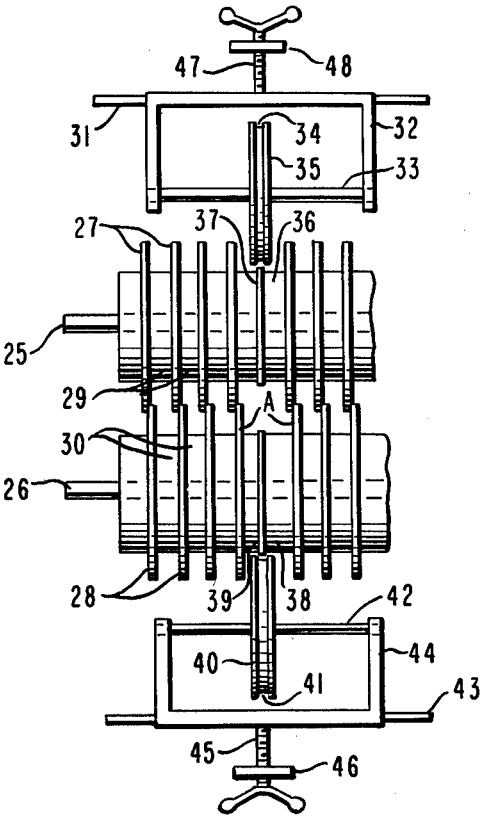
FIG. 3 is an elevation of a portion of the rotary scissor blades mounted in pairs on two shafts, and of supports for said shafts.

In FIG. 3, shafts 25 and 26 are arranged so that circular scissor blades 27 mounted on shaft 25 are in side-by-side contact at their periphery with complementary scissor blades 28 mounted on shaft 26. Each shaft is supported by bearings at each end and each shaft is also acted upon by a thrust bearing at one end.

Figure 4:
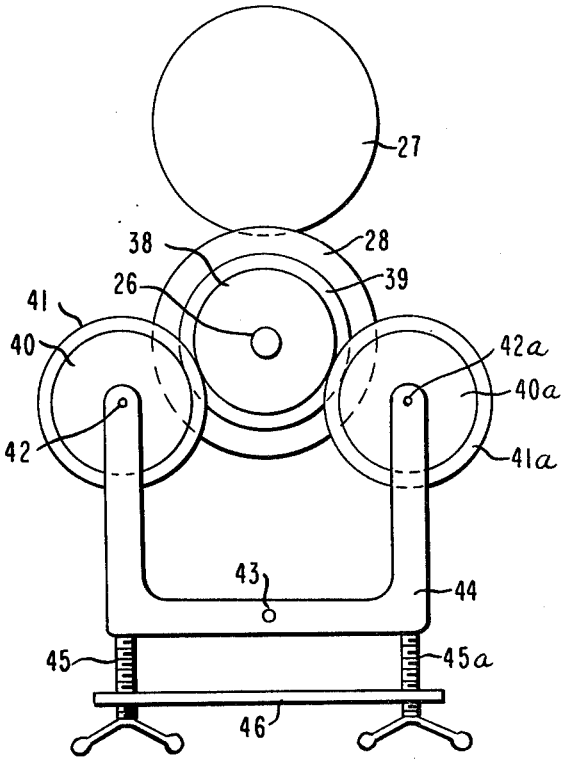
FIG. 4 is a side view of a rotary scissor blade mounted on a shaft, and of a support for said shaft.

In the drawings, FIGS. 3 and 4 show support devices for long shafts 25 and 26. Spacers 29 and 30 are normally not wide enough to provide space for conventional supports to the shafts 25 and 26. Support for shaft 26 is hereinafter described. A support spacer 38 is mounted upon shaft 26 in a similar manner to spacers 30. Several support spacers, similar to support spacer 38, may be placed at appropriate intervals along the length of shaft 26. Support spacer 38 has a ridge 39 within its width and circumscribing said support spacer. Support spacer 38 is in contact with support wheels 40, and 40*a*, having grooves 41 and 41*a*, respectively, around the periphery of the wheels. The grooves 41 and 41*a* engage with ridge 39. The support wheels 40, 40*a* are mounted on support spindles 42 and 42*a*, respectively, which are journalled in a frame 44. The support wheels may move freely along the axis of the support spindle. Frame 44 is pivoted on axle 43. Axle 43 provides a pivot so that both support wheels 40 and 40*a* are always in contact with support spacer 38. To prevent bowing of shaft 26 support may be provided by buttressing frame 44 by means of screws 45 and 45*a* which are threaded through an immovable frame 46. Other means, for example springs, hydraulic rams, racks and pinions, for adequately buttressing frame 44, may be employed.

Shaft 25 is similarly supported by support spacer 36 through support wheels 35 mounted on spindle 33, said wheels and support spacer being held in alignment by ridge 37 and groove 34. Spindle 33 is journalled in frame 32 which, in turn, is supported and pivoted on axle 31. Frame 32 is also buttressed by screws 47 threaded through immovable frame 48.

A preferred operation of the apparatus described above is described hereinafter, with reference being made to FIGS. 1 and 2.

Flexible film mounted on rolls, for use in the process of the present invention may, for example, be prepared by extrusion of molten polymer through conventional flat or circular film dies, cooling the polymer, orienting the film so obtained and winding the film onto rolls. Each web of film 7, 8 and 9 is pulled from rolls of film 1, 2 and 3, respectively. Shafts 4, 5 and 6 have braking devices for controlling tensions of the webs of film. Webs of film 7, 8 and 9 are pulled around rotatable bowed rollers 12, 13 and 14, respectively, or similar devices for removing wrinkles from the webs of film. Guide rollers 10 and 11 may be included if the arrangement of rolls 1, 2 and 3 would allow intereference of one web with another while being withdrawn from the rolls. The three webs are then superimposed at alignment roller 15. The superimposed webs are then fed through an assembly of circular scissor blades 16. The overlap of complementary circular scissor blades 27 and 28 is set to be greater than the combined thickness of webs 7, 8 and 9. Corresponding blades and spacers on shafts 25, 26 are matched with respect to width, and shafts 25 and 26 are moved axially relative to one another to ensure that all complementary pairs of scissor blades 27 and 28 are in positive contact with one another. The shafts are normally driven so that the meeting edges of meshing scissor blades meet the unslit superimposed webs, as shown by the direction of the arrows in FIG. 2. The shafts are normally rotated so that the speed of the periphery of a scissor blade is 20 to 50% faster than the linear speed of the superimposed webs through the slitting device. Rotation at this speed ensures efficient slitting and self sharpening of the scissor blades. The speed of rotation of the scissor blades is not critical to the operation of the process. For example, it has not proved harmful to the slit tapes to stop rotation of the scissor blades. Referring again to FIGS. 1 and 2: after passing through the assembly of circular scissor blades 16, the longitudinally slit superimposed webs 7, 8 and 9, now forming superimposed companion tapes, for example 17, 18, 19, which remain attached to said webs, are pulled through the pair of nip rolls 20 and 21, which are rotatable but not driven. Thereafter the superimposed tapes are separated and threaded through guides 22 which are close to the warp beam 23. The nip rolls and the alignment roller 15 are aligned so that the superimposed webs meet the intersection of scissor blades 27 and 28. The nip rolls also ensure that the superimposed tapes slit from the superimposed webs are pulled past the contacting scissor blades without deviation from their path of travel. It has been found that the component of the pulling forces, parallel to the axes of the nip rolls, on the separated tapes are insufficient to cause the tapes to move along the width of the nip rolls to the edge of the nip rolls, even though the outer separation angle of the outermost tapes be as great as approximately 15 degrees.

In a preferred embodiment of the process of the present invention the warp beam is rotated at a speed such that the rate of wind-up onto the beam is relatively constant. The tapes and the webs to which they are attached are tensioned by applying braking forces to the webs of film at their source; for example, by applying braking forces to shafts 4, 5 and 6 in FIG. 1 of the drawings.

Figure 2:
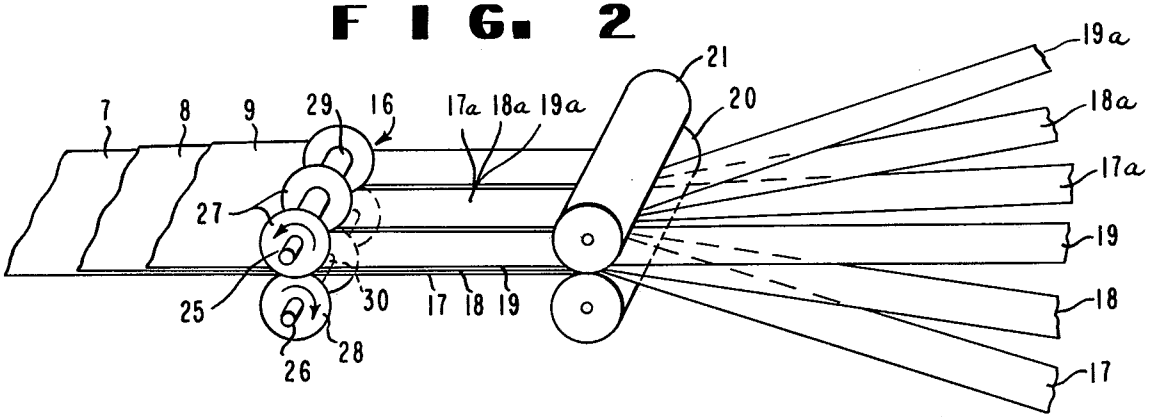
FIG. 2 is a schematic representation of superimposed webs being slit into tapes by a plurality of rotary scissors according to the process of the present invention.

Superimposed companion tapes 17, 18 and 19 may be separated side-by-side and in proximity to one another as shown in FIG. 2. The superimposed companion tapes 17*a*, 18*a* and 19*a* slit from an adjacent portion of the superimposed webs are separated similarly to companion tapes 17, 18, 19 and fed through guides 22. In FIGS. 1 and 2 only a few tapes are shown, for clarity.

Up to about 1000 tapes from webs at least 1 m in width may be slit using the process of the present invention. Space limitations usually make it impractical to space the warp beam and slitting device apart enough to maintain the outer separation angle less than about 8° and for that reason fanning of the tapes to an outer separation angle of at least about 8° is preferred.

In a preferred embodiment of a support apparatus suitable for use in the process of the present invention, shown in FIGS. 3 and 4 the grooves in the support wheels 40 and 40*a* engage ridges 39 on support spacer 38 thus ensuring that the support wheels 40 and 40*a* do not strike the circular scissor blades A on either side of the support wheels thereby causing them to be bent or broken. The support wheels are allowed to move freely along the axis of the support spindles to provide the movement necessary when aligning the support wheels with the support spacers or when altering the tension along the shafts 25 or 26. It may be appreciated that support and alignment may also be accomplished by other means, such as a plurality of grooves or raised ridges on the support wheels and co-operating raised ridges or grooves on the support spacers. The points at which the support wheels and support spacers contact are normally lubricated.

The number of support apparatus necessary to support long shafts 25 and 26 depends on the dimensions and materials of construction of the shafts. For example, for shafts between about 1 m and 2.5 m in length and 76.2 mm in diameter and made from precision ground steel shafting having a tensile strength of about 793 to 999 MPa, at least one support apparatus for each shaft is preferred, two support apparatuses for each shaft being especially preferred.

The following examples serve to further illustrate the present invention.

EXAMPLE 1

Polyethylene film, 46 μm thick, 2.04 m wide, and of 0.960 g/cm$^3$ density taken from two rolls each containing film approximately 20 km in length, was superimposed, slit with approximately 780 pairs of scissor blades in tapes 2.54 mm in width. The superimposed tapes were separated at the nip rolls and each tape guided onto a warp beam 4.12 m in width, the tapes being in side by side arrangement: each tape slit from the uppermost web being adjacent to the companion tape slit from the lowermost web. The outer separation angle was 15°. The process operated so smoothly at a wind-up speed of 150 m/min that no tape breaks occurred.

EXAMPLE 2

Polyethylene film, 46 μm thick, 1.82 m wide, and of 0.960 g/cm$^3$ density taken from three rolls each containing film approximately 20 km in length was superimposed, slit with approximately 700 pairs of scissor blades into tapes 2.54 mm in width. The superimposed tapes were separated at the nip rolls and each tape guided onto a warp beam 5.38 m in width, the tapes being in side by side arrangement: each tape from the uppermost web being adjacent to the companion tape slit from the center web the same pairs of scissor blades; each tape slit from the center web also being adjacent to the companion tape slit from the lowermost web by the same pair of scissors; and each tape slit from the lowermost web also being adjacent to the tape slit from the uppermost web by adjacent pairs of scissors. The outer separation angle was 11° and the process operated as smoothly as in Example 1.

Flexible films which may usefully be slit and wound onto a warp beam in accordance with the process of the present invention include thermoplastic polymeric films made from, for example, oriented homopolymers and copolymers of α-olefins, polyesters, polyamides or laminates thereof. Examples of such films are those made from low density polyethylene, high density polyethylene, polypropylene, polyethylene filled with inorganic fillers, nylon 6,6, and flexible films coated with organic or inorganic materials. Tapes prepared by the process of the present invention may be as narrow as 1.0 mm in width, and are preferably 2 to 5 mm in width.

Although the process claimed is particularly useful for producing tapes suitable for weaving, it is not restricted to such end use.

I claim:

1. A process for preparing a warp beam wound with a plurality of tapes slit from at least two substantially continuous flat webs of flexible film superimposed upon each other, each web being at least 1 meter wide, said process comprising the steps of (a) removing wrinkles from said webs of flexible film
(b) superimposing said webs
(c) slitting the superimposed webs longitudinally into a plurality of tapes
(d) feeding the superimposed tapes so formed through a pair of undriven nip rolls
(e) separating the superimposed tapes at the nip of said undriven nip rolls; each separated tape slit from one of the superimposed webs being arranged in the same plane with and in proximity to companion tapes slit from the other webs and the outer separation angle of the slit tapes being from 8° to 15°
(f) winding the separated tapes onto a driven warp beam
(g) applying tension to each web sufficient to give all of the tapes substantially the same tension at the warp beam.

2. A process according to claim 1 wherein the substantially continuous flat webs of flexible film are supplied from rolls of film arranged in tandem.

3. A process according to claim 2 wherein the substantially continuous flat webs of flexible film are supplied from three rolls of film arranged in tandem.

4. A process according to claim 3 wherein the separated tapes are wound onto the warp beam in a side-by-side arrangement, such that three companion superimposed tapes slit from the three superimposed webs are separated and wound side-by-side onto the warp beam and companion tapes slit from an adjacent portion of said webs are similarly separated, and wound side-by-side onto the warp beam adjacently to said three separated tapes.

5. A process according to claim 2 wherein the substantially continuous flat webs of flexible film are supplied from two rolls of film arranged in tandem.

6. A process according to claim 5 wherein the separated tapes are wound onto the warp beam in a side-by-side arrangement, each tape slit from one of the webs being adjacent to the tape slit from the superimposed web.

7. A process according to claim 2 wherein the flexible film is oriented thermoplastic polymeric film.

8. A process according to claim 7 wherein the oriented thermoplastic polymeric film is $\alpha$-olefin polymer.

9. A process according to claim 8 wherein each tape is at least 1 mm in width.

10. A process according to claim 8 wherein each tape is between 2 and 5 millimeters in width.

* * * * *